US008371101B2

(12) United States Patent
Zuo et al.

(10) Patent No.: US 8,371,101 B2
(45) Date of Patent: Feb. 12, 2013

(54) RADIAL INLET GUIDE VANES FOR A COMBUSTOR

(75) Inventors: Baifang Zuo, Greenville, SC (US); Derrick Simons, Greenville, SC (US); William York, Greenville, SC (US); Willy S. Ziminsky, Greenville, SC (US)

(73) Assignee: General Electric Company, Schenectady, NY (US)

( * ) Notice: Subject to any disclaimer, the term of this patent is extended or adjusted under 35 U.S.C. 154(b) by 408 days.

(21) Appl. No.: 12/559,522

(22) Filed: Sep. 15, 2009

(65) Prior Publication Data

US 2011/0061389 A1 Mar. 17, 2011

(51) Int. Cl.
*F02C 7/057* (2006.01)

(52) U.S. Cl. ..... 60/39.23; 60/748

(58) Field of Classification Search ..... 60/737, 60/740–748, 39.23; 431/9, 354; 239/403, 239/549, 556
See application file for complete search history.

(56) References Cited

U.S. PATENT DOCUMENTS 2,889,871 A * 6/1959 Voorheis ..... 431/9
5,394,688 A * 3/1995 Amos ..... 60/39.23
5,490,378 A * 2/1996 Berger et al. ..... 60/39.23
5,660,044 A * 8/1997 Bonciani et al. ..... 60/737
5,983,642 A * 11/1999 Parker et al. ..... 60/737
7,086,234 B2 * 8/2006 Doerr et al. ..... 60/776
7,685,824 B2 * 3/2010 Dahm ..... 60/767
7,780,151 B2 * 8/2010 Carroni ..... 261/79.1
2002/0162333 A1 * 11/2002 Zelina ..... 60/776
2007/0028618 A1 * 2/2007 Hsiao et al. ..... 60/737
2009/0320484 A1 * 12/2009 Lacy et al. ..... 60/748

OTHER PUBLICATIONS

Willy Steve Ziminsky, et al., Title: Premixed Direct Injection Nozzle, filed on Feb. 4, 2009, and assigned U.S. Appl. No. 12/365,382.
Baifang Zuo, et al., Title: Premixed Direct injection Nozzle, filed on Oct. 3, 2008, and assigned U.S. Appl. No. 12/245,266.
Benjamin Paul Lacy, et al., Title: Bundled Multi-Tube Nozzle for a Turbomachine, filed on Jan. 23, 2009, and assigned U.S. Appl. No. 12/358,805.
William David York, et al., Title: Premixed Direct Injection Disk, filed on Feb. 27, 2009, and assigned U.S. Appl. No. 12/394,544.
Benjamin Lacy, et al., Title: Combustor Can Flow Conditioner, filed on Jul. 1, 2009, and assigned U.S. Appl. No. 12/495,951.

* cited by examiner

*Primary Examiner* — Phutthiwat Wongwian
(74) *Attorney, Agent, or Firm* — Sutherland Asbill & Brennan LLP

(57) ABSTRACT

A combustor may include an interior flow path therethrough, a number of fuel nozzles in communication with the interior flow path, and an inlet guide vane system positioned about the interior flow path to create a swirled flow therein. The inlet guide vane system may include a number of windows positioned circumferentially around the fuel nozzles. The inlet guide vane system may also include a number of inlet guide vanes positioned circumferentially around the fuel nozzles and adjacent to the windows to create a swirled flow within the interior flow path.

20 Claims, 4 Drawing Sheets

RADIAL INLET GUIDE VANES FOR A COMBUSTOR

FEDERAL RESEARCH STATEMENT

This invention was made with government support under Contract No. DE-FC26-05NT42643, awarded by the U.S. Department of Energy ("DOE"). The United States has certain rights in this invention.

TECHNICAL FIELD

The present application relates generally to gas turbine engines and more particularly relates to the use of radial inlet guide vanes or swirlers in a combustor so as to provide a more even airflow distribution to the combustor nozzles.

BACKGROUND OF THE INVENTION

In a gas turbine, operational efficiency increases as the temperature of the combustion gas stream increases. Higher gas stream temperatures, however, may produce higher levels of nitrogen oxide ($NO_x$), an emission that is subject to both federal and state regulation in the U.S. and subject to similar regulations abroad. A balancing act thus exists between operating the gas turbine in an efficient temperature range while also ensuring that the output of $NO_x$ and other types of emissions remain below the mandated levels.

Recent combustion concepts involve the use of a number of nozzles with many small passages in the combustor as opposed to several nozzles with larger passages. These nozzles with small passages offer fast fuel/air mixing in a short flow residence time. The nozzles also provide strong wall heat transfer in combination with effective cooling using fuel and/or air. Thus, these small nozzles or other types of combustion nozzles may have the capability to reduce emissions and also to permit the use of highly reactive types of syngas and other fuels, especially high hydrogen fuels. The design of the nozzles, however, may need to utilize more of the combustor cap space so as to distribute the air properly among the numerous small nozzles.

To minimize the emissions and the potential for flashback, it may be desirable to have as uniform an airflow distribution across the nozzles as possible. Current combustor designs may have nozzle to nozzle or even passage to passage airflow variations therein. The outer most nozzles or tubes may receive less airflow due to a local flow separation as the air approaches the nozzles. Such separation may impact nozzle operability as the nozzles with less airflow may suffer flame holding or flashback. Separation also may impact combustion generated emissions, such as Nitrogen Oxides (NOx) and Carbon Monoxide (CO). The extent of the uneven airflow distribution also may change with load or the total air mass flow rate. In the case of a combustor with a short liner or no liner, the cap surface may be curved so as to let the nozzles flow slightly inward. Such a design, however, may need more air near the outer diameter region then currently may be provided.

There is thus a desire to provide a more uniform airflow distribution about the combustor and the combustor cap. Preferably such a uniform airflow should provide both reduced emissions as well as improving the overall performance of the gas turbine engine, particularly with the use of highly reactive syngas, hydrogen fuels, and similar types of fuels.

SUMMARY OF THE INVENTION

The present application thus provides a combustor. The combustor may include an interior flow path therethrough, a number of nozzles in communication with the interior flow path, and an inlet guide vane system positioned about the interior flow path to create a swirled flow therein.

The present application further provides a combustor. The combustor may include an interior flow path therethrough, a premixed direct injection nozzle in communication with the interior flow path, and a number of inlet guide vanes positioned about the interior flow path to create a swirling flow therein.

The present application further provides a combustor. The combustor may include an interior flow path therethrough, a cap member, a number of nozzles positioned within the cap member and in communication with the interior flow path, and a number of inlet guide vanes positioned about the interior flow path. The inlet guide vanes may extend from a lower portion of a flow passage to create a partly swirling flow and may terminate about a window of the flow passage so as to create a partly non-swirling flow such that an overall swirling flow may have a substantially even distribution across the nozzles.

These and other features and improvements of the present application will become apparent to one of ordinary skill in the art upon review of the following detailed description when taken in conjunction with the several drawings and the appended claims.

DETAILED DESCRIPTION

Figure 1:
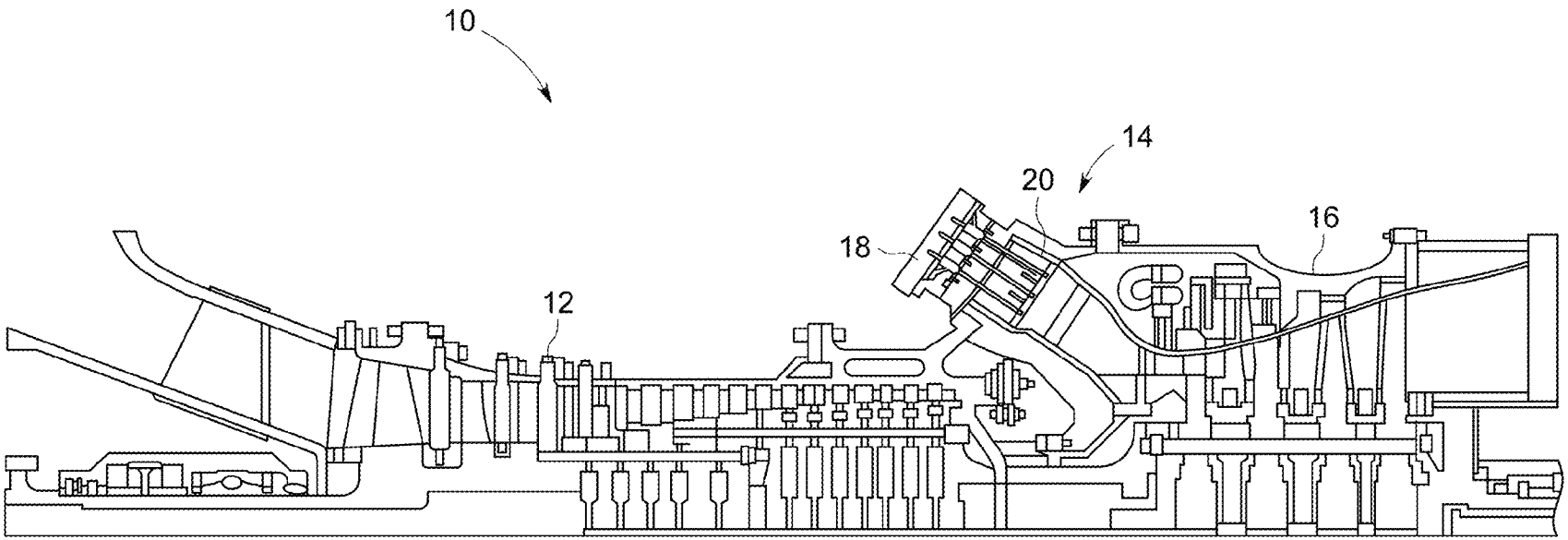
FIG. 1 is a side cross-sectional view of a gas turbine engine that may be used with the combustor as is described herein.

Referring now to the drawings, in which like numbers refer to like elements throughout the several views, FIG. 1 shows a side cross-sectional view of a gas turbine engine 10. As is known, the gas turbine engine 10 may include a compressor 12 to compress an incoming flow of air. The compressor 12 delivers the compressed flow of air to a combustor 14. The combustor 14 mixes the compressed flow of air with a compressed flow of fuel and ignites the mixture. (Although only a single combustor 14 is shown, the gas turbine engine 10 may include any number of combustors 14.) The hot combustion gases are in turn delivered to a turbine 16. The hot combustion gases drive the turbine 16 so as to produce mechanical work. The mechanical work produced in the turbine 16 drives the compressor 12 and an external load such as an electrical generator and the like.

The gas turbine engine 10 may use natural gas, various other types of syngas, and other types of fuels. The gas turbine engine may be a 7F or a 9F heavy duty gas turbine engine offered by General Electric Company of Schenectady, New York. The gas turbine engine 10 may have other configurations and may use other types of components. Other types of gas turbine engines may be used herein. Multiple gas turbine engines 10, other types of turbines, and other types of power generation equipment may be used herein together.

Figure 2:
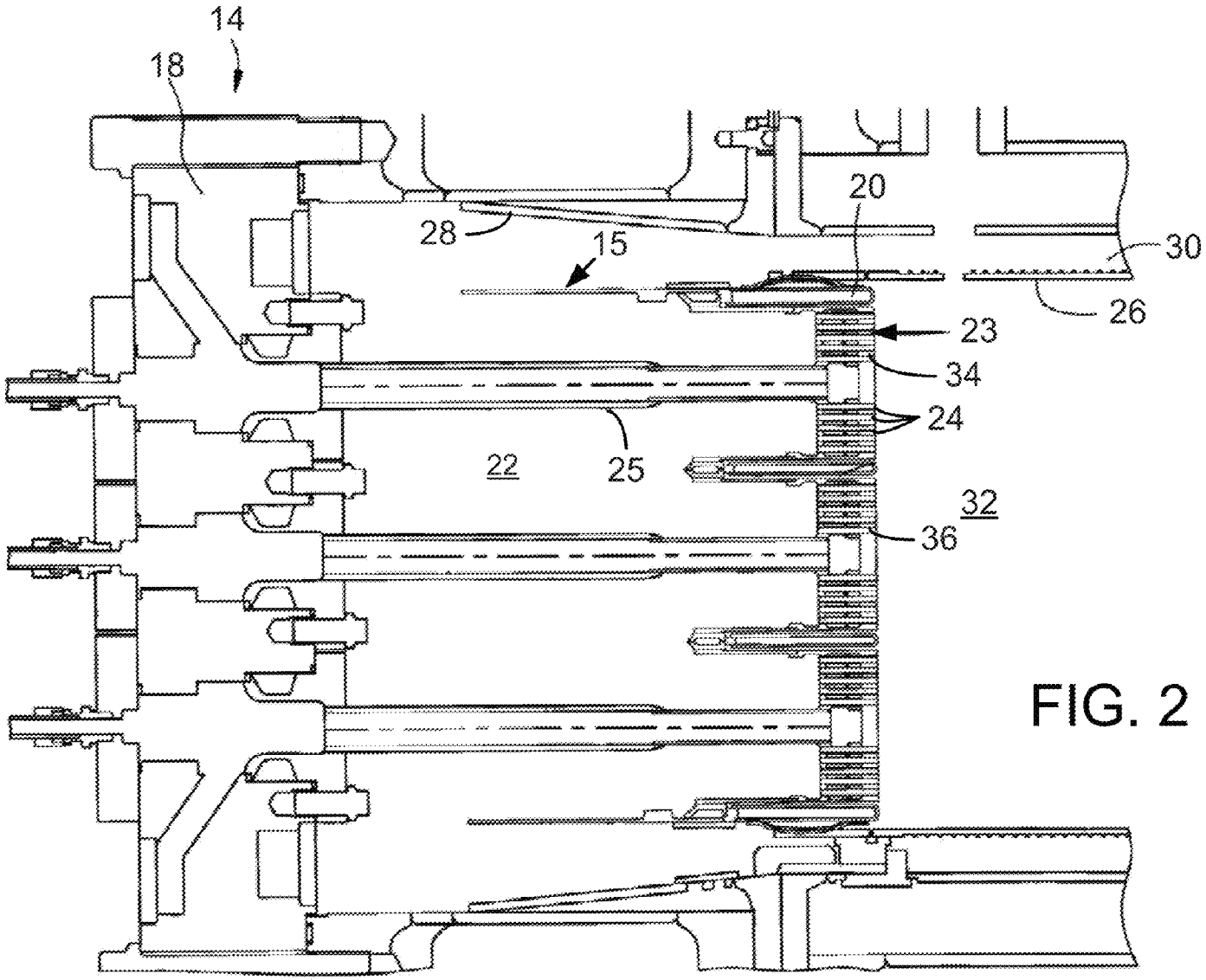
FIG. 2 is a side cross-sectional view of a combustor can with a number of bundled multi-tube injection nozzles of the gas turbine engine of FIG. 1.

FIG. 2 shows a side cross-sectional view of an example of a combustor 14 that may be used herein. The combustor 14 includes a combustor can 15 that extends from an end cover 18 positioned at a first end thereof to a cap member 20 at the opposite end thereof. The cap member 20 may be spaced from the end cover 18 so as to define an interior flow path 22 for a flow of the compressed air through the combustor can 15. The cap member 20 may define a premixed direct injection nozzle 23 extending therethrough or other type of fuel nozzle or injector. The premixed direct injection nozzle 23 may include a number of small nozzles 24 in communication with a fuel path 25. The small nozzles 24 may be positioned at an angle or they may be straight. The fuel path 25 may extend from the end cover 18 to the fuel nozzles 23 to deliver a flow of fuel thereto. The premixed injection nozzle 23 generally provides good fuel air mixing with low combustion generated $NO_x$ and low fuel pressure loss so as to provide high system efficiency.

The combustor 14 further includes a combustor liner 26 and a flow sleeve 28 positioned upstream of the combustor can 15. The combustion liner 26 and the flow sleeve 28 may define an outer flow path 30 therethrough in reverse flow communication with the interior flow path 22. The outer flow path may provide cooling to the combustion liner 26.

Air from the compressor 12 thus flows through the outer flow path 30 between the combustion liner 26 and the flow sleeve 28 and then reverses into the combustor can 15. The air then flows through the interior flow path 22 defined between the end cover 18 and the cap member 20. As the air passes through the premixed direct injection nozzles 23 of the cap member 20, the air is mixed with a flow of fuel from the fuel path 25 and is ignited within a combustion chamber 32. The combustor 14 shown herein is by way of example only. Many other types of combustor 14 designs and combustion methods may be used herein.

As the airflow approaches the nozzles 23 of the cap member 20 through the interior flow path 22, there may be a large velocity distribution variance across the cap member 20. These velocity variances may be particularly an issue given the use of several premixed direct injection nozzles 24, each with a number of small tubes 24, as opposed to the use of a few of the known larger nozzles. Such velocity variances may impact on emission levels and other types of combustion dynamics as is described above. These velocity variances may extend from an outer diameter region 34 towards a central region 36 of the cap member 20.

Figure 3:
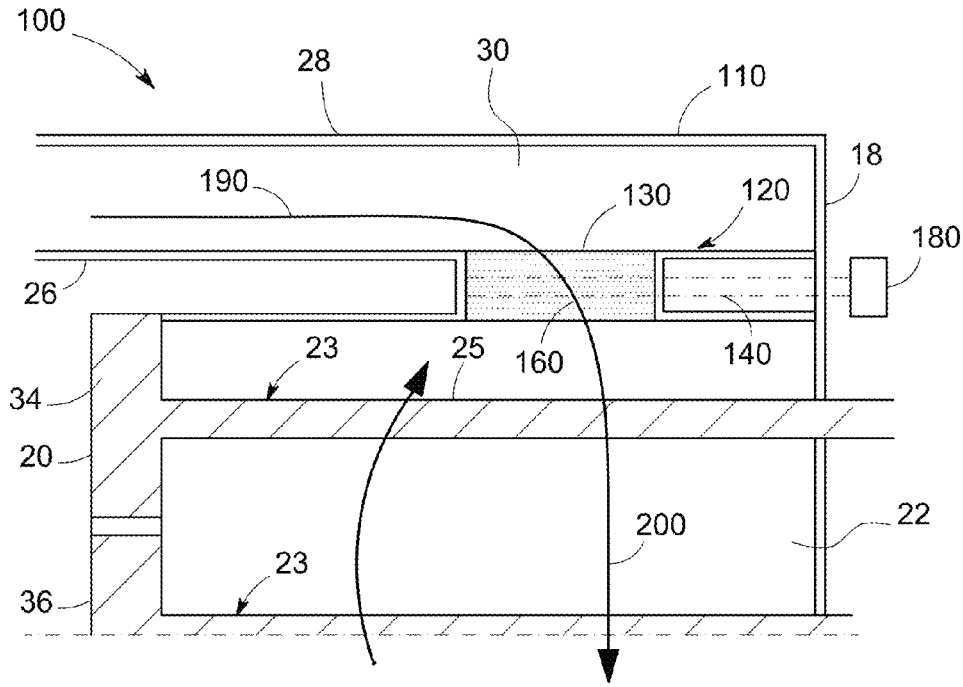
FIG. 3 is a side cross-sectional view of a combustor with an inlet guide vane system as is described herein.
Figure 4:
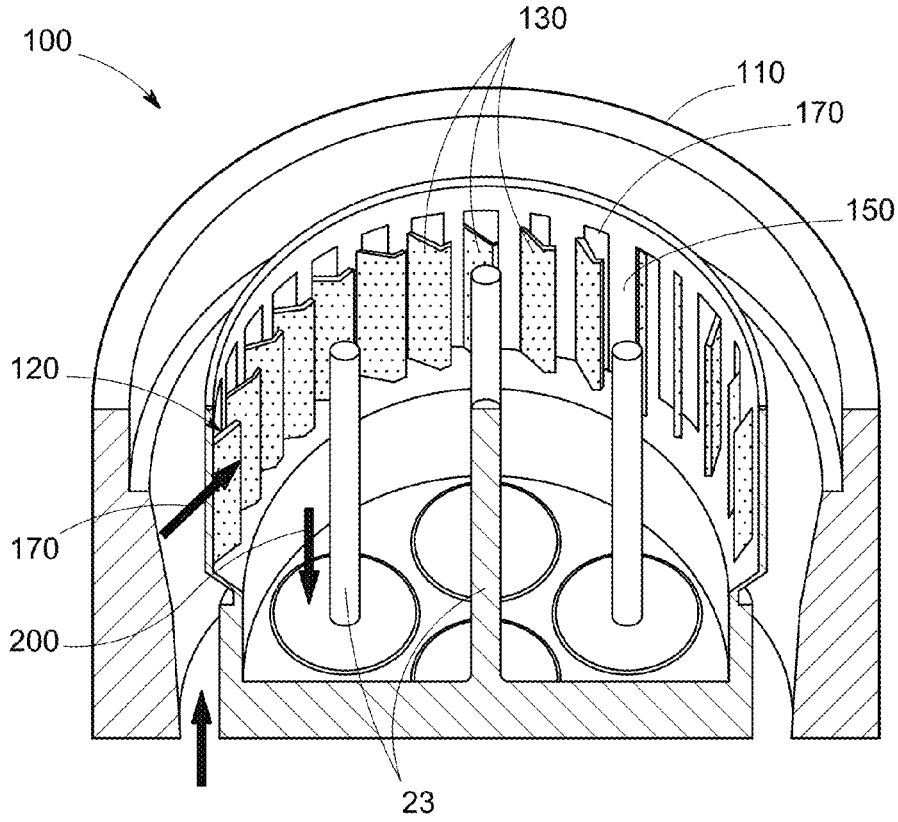
FIG. 4 is a side cross-sectional view of the combustor with the inlet guide vane system of FIG. 3.
Figure 5:
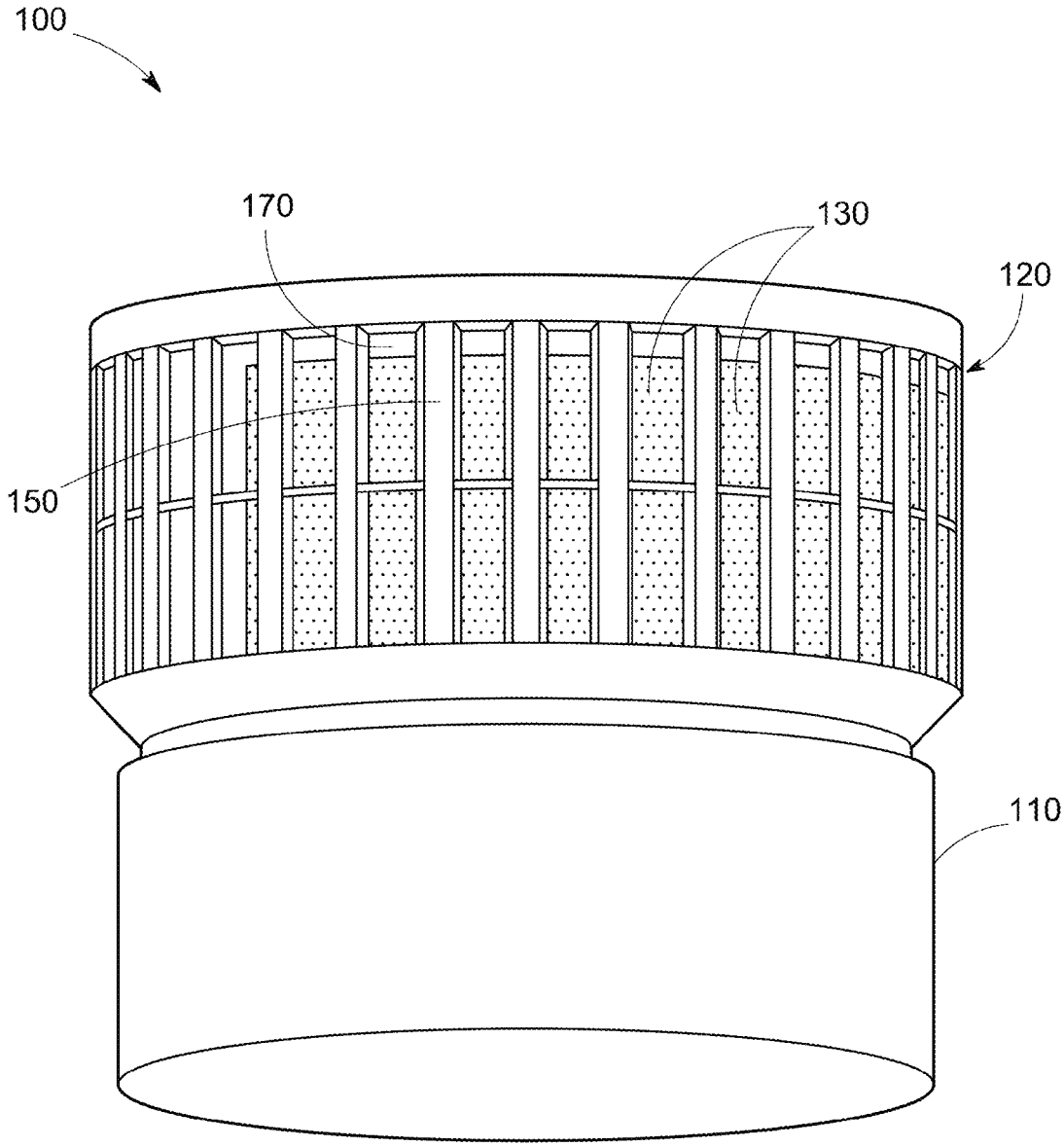
FIG. 5 is a plan view of the combustor with the inlet guide vane system of FIG. 3.

FIGS. 3-5 show a side cross-sectional view of a combustor 100 as may be described herein. The combustor 100 may include a combustor can 110 similar to that described above. Combustor 100 may include an inlet guide vane system 120 positioned therein. The inlet guide vane system 120 acts as a flow conditioner and may be positioned about the outer flow path 30 between the combustion liner 26 and the flow sleeve 28. The inlet guide vane system 120 may be mounted to the end cover 18 or otherwise positioned.

The inlet guide vane system 120 may include a number of guide vanes 130 with each guide vane 130 radially positioned on an axis 140 for rotation therewith. The guide vanes 130 may be positioned about at a lower part 150 of a flow passage 160 through combustion liner 26. The guide vanes 130 may terminate lengthwise at a window 170 of the flow passage 160 at a top part thereof (close to the end cover 18). The area ratio of the lower part 150 of the flow passage 160 with the number of guide vanes 130 to the window 170 of the flow passage 160 without the guide vanes 130 may be varied to achieve the desired air flow distribution among the downstream nozzles. The angle of the guide vanes 130 may be fixed or adjustable. Any number or shape of the guide vanes 130 may be used. The axes 140 may be attached to a drive motor 180 or otherwise powered.

In use, an air flow 190 may advance along the outer flow path 30 and may pass through the inlet guide vane system 120 and into the interior flow path 22 towards the small nozzles 23 of the cap member 20. The guide vanes 130 may induce a certain swirl angle such that a swirling flow 200 may be created with a higher pressure near the outer diameter region 34 of the cap member 20. The strength of the swirling flow 200 may be controlled by changing the swirl angle and/or the length of the guide vanes 130. A transfer function thus may be established between the swirl angle of the guide vanes 130 and the airflow rate so as to ensure a substantially even air distribution across cap member 20 and the nozzles 23 at both full load and part load conditions.

The length and chord length of the guide vanes 130, together with the swirl angle, may be optimized so as to give a more uniform air form distribution across the nozzles 24. Moreover, the inlet guide vanes 130 may create at least a partly swirling flow while the window 170 of the flow passage 160 may create a partly non-swirling flow such that the resultant overall swirling flow 200 may have a more even distribution across the nozzles 24.

The inlet guide vane system 120 thus provides a low pressure loss and variable swirl conditioner so as to provide a uniform airflow distribution among the nozzles 24 at all load conditions. The inlet guide vane system 120 provides such uniform air distribution even in the context of the use of a short liner 26 with high hydrogen fuel combustion.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A combustor, comprising:

an interior flow path therethrough;

a plurality of axially extending and radially spaced apart fuel nozzles in communication with the interior flow path; and an inlet guide vane system positioned about the interior flow path and upstream of the plurality of axially extending and radially spaced apart fuel nozzles to create a swirled flow therein, the inlet guide vane system, comprising:

a plurality of windows positioned circumferentially around and upstream of the plurality of axially extending and radially spaced apart fuel nozzles; and a plurality of adjustable inlet guide vanes positioned circumferentially around and upstream of the plurality of axially extending and radially spaced apart fuel nozzles and adjacent to the plurality of windows.

2. The combustor of claim 1, wherein the plurality of adjustable inlet guide vanes extends from a lower portion of a flow passage.

3. The combustor of claim 2, wherein a radial distance between the lower portion of the flow passage to the window of the flow passage may be varied.

4. The combustor of claim 1, wherein the plurality of adjustable inlet guide vanes are adjustable relative to the plurality of windows.

5. The combustor of claim 4, wherein the inlet guide vane system further comprises:

a plurality of axially extending axes positioned circumferentially around and upstream of the plurality of axially extending and radially spaced apart fuel nozzles and adjacent to the plurality of windows; and one or more drive motors having a respective axes of the plurality of axially extending axes extending therethrough, wherein each of the plurality of adjustable inlet guide vanes is associated with the respective axes such that the plurality of adjustable inlet guide vanes are rotated about the respective axes to adjust the plurality of inlet guide vanes relative to the plurality of windows.

6. The combustor of claim 1, further comprising an end cover and wherein the inlet guide vane system is mounted about the end cover.

7. The combustor of claim 1, further comprising a combustion liner and a flow sleeve defining an outer flow path therethrough and wherein the inlet guide vane system is positioned between the outer flow path and the interior flow path.

8. The combustor of claim 1, further comprising a cap member with an outer diameter region and a central region and wherein the swirling flow comprises a substantially even distribution across the outer diameter region and the central region.

9. The combustor of claim 1, wherein the plurality of axially extending and radially spaced apart fuel nozzles comprises a plurality of small tube nozzles.

10. The combustor of claim 1, wherein the inlet guide vane system acts as a flow conditioner.

11. A combustor, comprising:

an interior flow path therethrough;

a plurality of axially extending and radially spaced apart premixed direct injection fuel nozzles in communication with the interior flow path; and an inlet guide vane system positioned about the interior flow path and upstream of the plurality of axially extending and radially spaced apart premixed direct injection fuel nozzles to create a swirling flow therein, the inlet guide vane system, comprising:

a plurality of windows positioned circumferentially around and upstream of the plurality of axially extending and radially spaced apart premixed direct injection fuel nozzles; and a plurality of adjustable inlet guide vanes positioned circumferentially around and upstream of the plurality of axially extending and radially spaced apart premixed direct injection fuel nozzles and adjacent to the plurality of windows.

12. The combustor of claim 11, wherein the plurality of adjustable inlet guide are adjustable relative to the plurality of windows.

13. The combustor of claim 11, wherein the plurality of adjustable inlet guide vanes extends from a lower portion of a flow passage.

14. The combustor of claim 13, wherein a radial distance between the lower portion of the flow passage to the window of the flow passage may be varied.

15. The combustor of claim 11, further comprising an end cover and wherein the inlet guide vane system is mounted about the end cover.

16. The combustor of claim 11, further comprising a combustion liner and a flow sleeve defining an outer flow path therethrough and wherein the inlet guide vane system is positioned between the outer flow path and the interior flow path.

17. The combustor of claim 11, further comprising a cap member with an outer diameter region and a central region and wherein the swirling flow comprises a substantially even distribution across the outer diameter region and the central region.

18. The combustor of claim 17, wherein the swirling flow comprises a higher pressure near the outer diameter region of the cap member as compared to the central region.

19. The combustor of claim 11, wherein the plurality of axially extending and radially spaced apart premixed direct injection nozzles comprises a plurality of small tube nozzles.

20. A combustor, comprising:

an interior flow path therethrough;

a cap member;

a plurality of axially extending and radially spaced a art fuel nozzles positioned within the cap member and in communication with the interior flow path;

a plurality of windows positioned circumferentially around and upstream of the plurality of fuel nozzles; and a plurality of adjustable inlet guide vanes positioned circumferentially around and upstream of the plurality of fuel nozzles and adjacent to the plurality of windows.

* * * * *